United States Patent [19]

Kanao

[11] Patent Number: 4,624,603

[45] Date of Patent: Nov. 25, 1986

[54] UNDERGROUND DRAIN PIPE

[76] Inventor: Shiro Kanao, No. 9-18, Napeidai 4-chome, Takatsukishi, Osaka, Japan

[21] Appl. No.: 702,103

[22] Filed: Feb. 15, 1985

[30] Foreign Application Priority Data

Nov. 19, 1984 [JP] Japan ..... 59-175455[U]

[51] Int. Cl.[4] ..... E02B 11/00

[52] U.S. Cl. ..... 405/49; 405/43; 138/154; 29/456;

[58] Field of Search ..... 405/43, 45, 48, 49; 138/154, 122, 173, 150; 285/DIG. 4; 29/456, 163.5; 156/95, 187

[56] References Cited

U.S. PATENT DOCUMENTS

| | | | |
|---|---|---|---|
| 3,878,685 | 4/1975 | Schmunk | 405/49 |
| 3,926,222 | 12/1975 | Shroy et al. | 405/49 |
| 4,113,818 | 9/1978 | Drossbach | 405/49 |
| 4,163,619 | 8/1979 | Fales | 405/49 |
| 4,175,882 | 11/1979 | Gilead | 405/43 |
| 4,487,232 | 12/1984 | Kanao | 138/150 |
| 4,523,613 | 6/1985 | Fouss et al. | 405/43 |

*Primary Examiner*—Cornelius J. Husar
*Assistant Examiner*—Kristina I. Hall
*Attorney, Agent, or Firm*—Sughrue, Mion, Zinn, Macpeak and Seas

[57] ABSTRACT

An underground drain pipe having an improved soil pressure resisting strength. A main portion of the pipe is constituted by a generally U-shaped strengthening member. The strengthening member is wound in a spiral with the open sides thereof directed inwardly. The strengthening member has flange webs projecting longitudinally from the inward edges thereof. A flat band having holes formed therein is wound around the strengthening member along the gap. The flat band has a plurality of small holes formed therein restricted to the area of the gap. If desired, the interior portions of the strengthening member can be sealed with a second band attached to the opposite side of the flange webs from the band having the holes formed therein.

6 Claims, 6 Drawing Figures

UNDERGROUND DRAIN PIPE

BACKGROUND OF THE INVENTION

The present invention relates to an underground drain pipe, such as a culvert drain pipe, which is used to collect underground water and conduct it to a disposal channel.

Several underground drain pipes of the same type to which the present invention pertains have been proposed. In one case, the pipe is formed with a number of small holes formed through the wall of the pipe. Another example of a conventional pipe was proposed by the present applicant is illustrated in FIG. 1. This pipe is constructed by spirally winding a band 02 of unwoven cloth having therein a large number of small holes 011 with a predetermined spacing between adjacent edges of the band 02. A separately formed thick band 01 of a hard synthetic resin is would over the gap formed between adjacent edges of the band 02 of unwoven cloth. Adjacent edge portions 022 and 023 of the band 02 of unwoven cloth are joined to respective edge portions 011 and 012 of the thick band 01 of hard synthetic resin.

A drain pipe having holes formed in the pipe wall after production of the pipe itself is disadvantageous in that the holing work is troublesome. Moreover, the pipe of FIG. 1 is disadvantageous in that, although it does not require holing work, problems are involved in cutting and joining the unwoven cloth. Particularly, if the diameter of the pipe is large, for instance, 500 mm or 1000 mm, the soil pressure is often sufficient to break the unwoven cloth. Also, there is a tendancy for the seam joints between the unwoven cloth and the hard resin band to separate.

SUMMARY OF THE INVENTION

Accordingly, it is an object of the present invention to provide a drain pipe in which the problems described above are eliminated.

In accordance with this and other objects, there is provided an underground drain pipe composed of a generally U-shaped band-like strengthening member wound in a spiral with the open side directed inwardly and with a gap left between adjacent edge portions. Between the adjacent edge portions is wound a band of material having small holes restricted to the central portions thereof. The continuous side edge portions of the band are joined to adjacent edge portions of the strengthening member.

DESCRIPTION OF THE PREFERRED EMBODIMENTS

Figure 2:
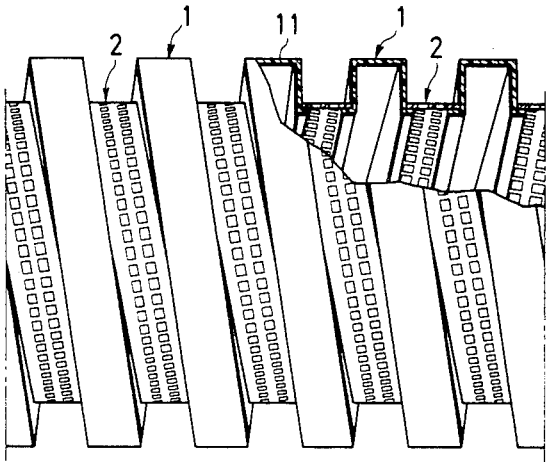
FIG. 2 is a side view, partially cut away and shown in cross section, of a drain pipe constructed in accordance with a first embodiment of the present invention.
Figure 3:
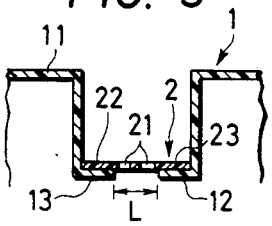
FIG. 3 is a cross-sectional view showing an enlargement of a portion of the pipe of FIG. 1.

Referring now to FIGS. 2 and 3, a first embodiment of a drain pipe of the invention will be described. The drain pipe of the first embodiment is composed of a generally U-shaped band, made of hard synthetic resin, forming a strengthening member 1. The open side of the U is directed inwardly. As shown most clearly in FIG. 3, flange webs 12 and 13 extend longitudinally from the inward side edges of the U-shaped central portion 11 of the strengthening member 1. The strengthening member 1 is wound in a spiral with a gap of width L between adjacent outward ends of the flange webs 12 and 13.

Figure 1:
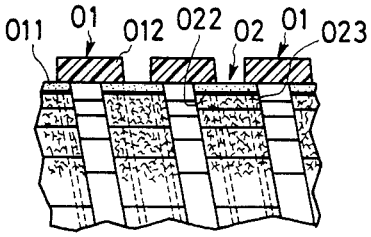
FIG. 1 PRIOR ART
FIG. 1 shows a cross-sectional view of a conventional drain pipe.
Figure 4:
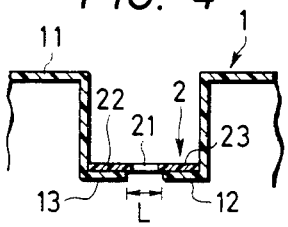
FIG. 4 is a view similar to FIG. 3 but relating to a second embodiment of the invention.
Figure 5:
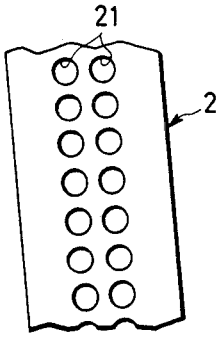
FIG. 5 is a plan view showing a flat band used in a third embodiment of the invention.

A flat band 2 having holes 21 restricted to a central portion thereof is wound in the space between the central portions 11 of the strengthening member 1. Side edges 22 and 23 are joined to the flange webs 13 and 12, respectively, such as by fusing or bonding with an adhesive. The holes 21 are restricted to the area of the gap between the ends of the flange webs 12 and 13. In the first embodiment illustrated in FIGS. 1 and 2, two rows of small holes 21 are formed in the flat band 2, whereas in a second embodiment illustrated in FIG. 4, a single row of holes 21 is employed. However, the number of rows of holes 21 is not limited to one and two, and three or four rows may be employed as well. In the embodiment depicted in FIG. 5, the holes 21 are circular. Of course, the shape of holes 21 is not so limited, and they may be, for instance, diamond shaped, rectangular, oval, or any other desired practical shape. The holes may be formed in a linear pattern or in a zigzag fashion.

Figure 6:
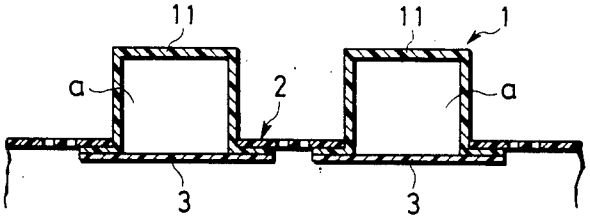
FIG. 6 is a cross-sectional view showing a portion of a fourth embodiment of a drain pipe of the invention.

As illustrated in FIG. 6, the open sides of the central portions 11 may be closed by a solid band 3 formed of synthetic resin, thereby to close the inner parts a of the central portion 11. The band 3 is joined to the flange webs 12 and 13 on the sides thereof opposite the flat band 2 by fusing, an adhesive, or the like.

For the synthetic resin material of the strengthening member 1, it is preferred to use an olefin-group synthetic resin such as polyethylene, polypropylene, or the like, or a vinyl chloride group resin. Also, a hard rubber material or a mixture of rubber and synthetic resin may be employed. For the flat band 2, the same material as employed for the strengthening member 1 is preferred in view of fusibility and secure bonding. Of course, other materials may be used if desired.

As described above in detail, the invention provides a drain pipe in which a U-shaped strengthening member constitutes a main part of the pipe, and a flat band is wound between the adjacent side portions of the spirally wound strengthening member having holes restricted to a central portion and falling in gaps between flange webs of the strengthening member. With this construction, most of the soil pressure is borne by the strengthening member. That soil pressure which acts on the flat band presses the flat band against the flange webs of the strengthening member so that the bonding between the flat band and the strengthening member is not affected. Accordingly, a drain pipe which provides a long service life is attained.

This completes the description of the preferred embodiments of the invention. Although preferred embodiments have been described, it is believed that numerous modifications and alterations thereto would be apparent to one of ordinary skill in the art without departing from the spirit and scope of the invention.

I claim:

1. An elongate underground pipe for draining off external fluids, comprising: a band-like strengthening member (1) having a U-shaped cross-section and flange webs (12, 13) extending outwardly from inward edges thereof, said strengthening member being spirally wound with a predetermined gap (L) between spaced adjacent edges of the said flange webs, with an opening of the U-shaped cross-section facing radially inwardly of the pipe, and with the flange webs defining a common cylindrical surface of revolution; and an apertured drainage band (2) externally wound around and bridging said gap, said band being bonded to underlying and radially outwardly facing surfaces of said flange webs, and said band defining a plurality of small holes (21) in a central zone thereof overlying said gap.

2. The pipe of claim 1, wherein said strengthening member and said band are both made of a synthetic resin material.

3. The pipe of claim 1, wherein said small holes in said band are disposed in two parallel rows.

4. The pipe of claim 1, wherein said small holes in said band are disposed in a single row.

5. The pipe of claim 1, wherein said band is bonded to said flange webs by one of a mode selected from the group comprising fusing and bonding with an adhesive.

6. The pipe of claim 1, further comprising a solid band (3) closing the inwardly facing opening of the strengthening member.

* * * * *